US010173111B2

(12) United States Patent
Busch et al.

(10) Patent No.: US 10,173,111 B2
(45) Date of Patent: Jan. 8, 2019

(54) ADJUSTABLE WEIGHTED GOLF CLUB HEAD

(71) Applicants: Maximilian Klaus Busch, San Diego, CA (US); David Marc Baranson, Encinitas, CA (US)

(72) Inventors: Maximilian Klaus Busch, San Diego, CA (US); David Marc Baranson, Encinitas, CA (US)

(73) Assignee: ArcLine Research, LLC, San Diego, CA (US)

( * ) Notice: Subject to any disclaimer, the term of this patent is extended or adjusted under 35 U.S.C. 154(b) by 0 days.

(21) Appl. No.: 15/499,879

(22) Filed: Apr. 27, 2017

(65) Prior Publication Data

US 2018/0311547 A1 Nov. 1, 2018

(51) Int. Cl.
*A63B 53/04* (2015.01)
*A63B 53/06* (2015.01)
*A63B 53/00* (2015.01)

(52) U.S. Cl.
CPC ..... *A63B 53/065* (2013.01); *A63B 53/007* (2013.01); *A63B 53/0487* (2013.01); *A63B 2053/0433* (2013.01); *A63B 2053/0491* (2013.01)

(58) Field of Classification Search
CPC ... A63B 53/06; A63B 53/0466; A63B 53/047; A63B 53/0487; A63B 53/065; A63B 53/007; A63B 2053/0491; A63B 2053/0433
See application file for complete search history.

(56) References Cited

U.S. PATENT DOCUMENTS

| | | | | |
|---|---|---|---|---|
| 4,008,896 | A * | 2/1977 | Gordos | A63B 53/0487 473/336 |
| 5,518,243 | A | 5/1996 | Redman | |
| 5,571,053 | A | 11/1996 | Lane | |
| 6,210,290 | B1 | 4/2001 | Erickson et al. | |
| 6,306,048 | B1 | 10/2001 | McCabe et al. | |
| 6,379,264 | B1 | 4/2002 | Forzano | |
| 6,485,375 | B1 | 11/2002 | McKinley | |
| 6,527,650 | B2 | 3/2003 | Reyes et al. | |
| 7,785,212 | B2 * | 8/2010 | Lukasiewicz, Jr. | A63B 53/0466 473/332 |
| 7,922,600 | B1 | 4/2011 | Ambrose | |
| 8,012,037 | B2 | 9/2011 | Evans et al. | |
| 8,016,694 | B2 | 9/2011 | Llewellyn et al. | |
| 8,696,491 | B1 * | 4/2014 | Myers | A63B 53/06 473/334 |
| 8,870,678 | B2 | 10/2014 | Beach et al. | |

(Continued)

OTHER PUBLICATIONS

Kozuchowski, Zak, "You Can See Inside Cobra's King LTD Drivers and Fairway Woods," Golf WRX, Aug. 18, 2015, http://www.golfwrx.com/322138/you-can-see-inside-cobras-king-ltd-drivers-and-fairway-woods/, printed Apr. 26, 2017.

*Primary Examiner* — John E Simms, Jr.
(74) *Attorney, Agent, or Firm* — Foley & Lardner LLP

(57) ABSTRACT

A golf club head includes a head body, a weight, a retaining element, and a cover. The head body defines an interior chamber. The weight is selectively received and repositionable within the interior chamber. The retaining element is positioned to selectively engage with the weight to secure the weight in a selected position. The cover is positioned to enclose the interior chamber of the head body.

20 Claims, 8 Drawing Sheets

(56) References Cited

U.S. PATENT DOCUMENTS

| | | | | |
|---|---|---|---|---|
| 8,888,609 | B2 | 11/2014 | Beach et al. | |
| 9,072,951 | B1 | 7/2015 | Tang et al. | |
| 9,238,162 | B2 * | 1/2016 | Breier | A63B 53/0466 |
| 9,381,410 | B2 | 7/2016 | Golden et al. | |
| 2002/0137576 | A1 * | 9/2002 | Dammen | A63B 53/04 473/336 |
| 2005/0233829 | A1 | 10/2005 | Cameron | |
| 2007/0135231 | A1 | 6/2007 | Lo | |
| 2007/0249432 | A1 * | 10/2007 | Wu | A63B 53/04 473/340 |
| 2011/0203443 | A1 * | 8/2011 | De Jule | G10D 3/04 84/622 |
| 2013/0237338 | A1 * | 9/2013 | Pak | A63B 53/14 473/285 |
| 2014/0038746 | A1 * | 2/2014 | Beach | A63B 53/0466 473/335 |
| 2015/0321055 | A1 * | 11/2015 | Golden | A63B 53/0466 473/338 |
| 2018/0056154 | A1 * | 3/2018 | Wallin | A63B 60/02 |

* cited by examiner

ADJUSTABLE WEIGHTED GOLF CLUB HEAD

BACKGROUND

Golf clubs may include heads that have one or more movable and/or detachable weights. These weights are typically repositionable between discrete, preset locations which minimize the adjustability of the center of gravity of the head. The weights are also typically externally disposed on the exterior of the head, negatively impacting the aesthetic design of the club and are often susceptible to debris buildup thereon.

SUMMARY

One embodiment relates to a golf club head. The golf club head includes a head body, a weight, a retaining element, and a cover. The head body defines an interior chamber. The weight is selectively received and repositionable within the interior chamber. The retaining element is positioned to selectively engage with the weight to secure the weight in a selected position. The cover is positioned to enclose the interior chamber of the head body.

Another embodiment relates to a kit for a golf club. The kit includes a weight configured to be received by an interior chamber of a golf club head. The weight includes a magnetically attractive material. The magnetic adjuster is configured to facilitate selectively repositioning the weight within the interior chamber of the golf club head.

Still another embodiment relates to a golf club. The golf club includes a shaft having a first end and an opposing second end, a grip coupled to the first end of the shaft, a head coupled to the opposing second end of the shaft, and a weight. The head defines a channel. The weight is selectively received within and repositionable along the channel. The position of the weight within the channel is magnetically adjustable.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The drawings are provided to illustrate example embodiments described herein and are not intended to limit the scope of the disclosure. Throughout the drawings, reference numbers may be re-used to indicate general correspondence between referenced elements.

DETAILED DESCRIPTION

Various aspects of the inventive concepts will now be described with regard to certain examples and embodiments, which are intended to illustrate but not to limit the disclosure. Nothing in this disclosure is intended to imply that any particular feature or characteristic of the disclosed embodiments is essential. The scope of protection is defined by the claims that follow this description and not by any particular embodiment described herein. Before turning to the figures, which illustrate example embodiments in detail, it should be understood that the application is not limited to the details or methodology set forth in the description or illustrated in the figures. It should also be understood that the terminology is for the purpose of description only and should not be regarded as limiting.

According to an example embodiment, a golf club head (e.g., a putter head, a driver head, etc.) defines an interior channel that receives a weight. The weight is continuously repositionable (e.g., movable, slidable, translatable, etc.) into various positions along the interior channel (e.g., to adjust the center of gravity of the golf club head, etc.). The golf club head may further include a cover or plate positioned to selectively enclose the interior channel such that the weight is enclosed therein. According to an example embodiment, the golf club head allows users to easily move and fix the weight at any location within the channel without direct, physical user manipulation in such a way to maximize the aesthetic appearance of the golf club head while preserving the function of the movable weight. Therefore, the golf club head may provide an adjustable weight system with minimal or no effect on appearance at address and from other viewing angles, where the adjustment mechanism is completely enclosed and protected from dirt, debris, grass, etc., while maximizing the ability to adjust the center of gravity thereof with the weight from the interior or exterior of the golf club head.

Figure 1:
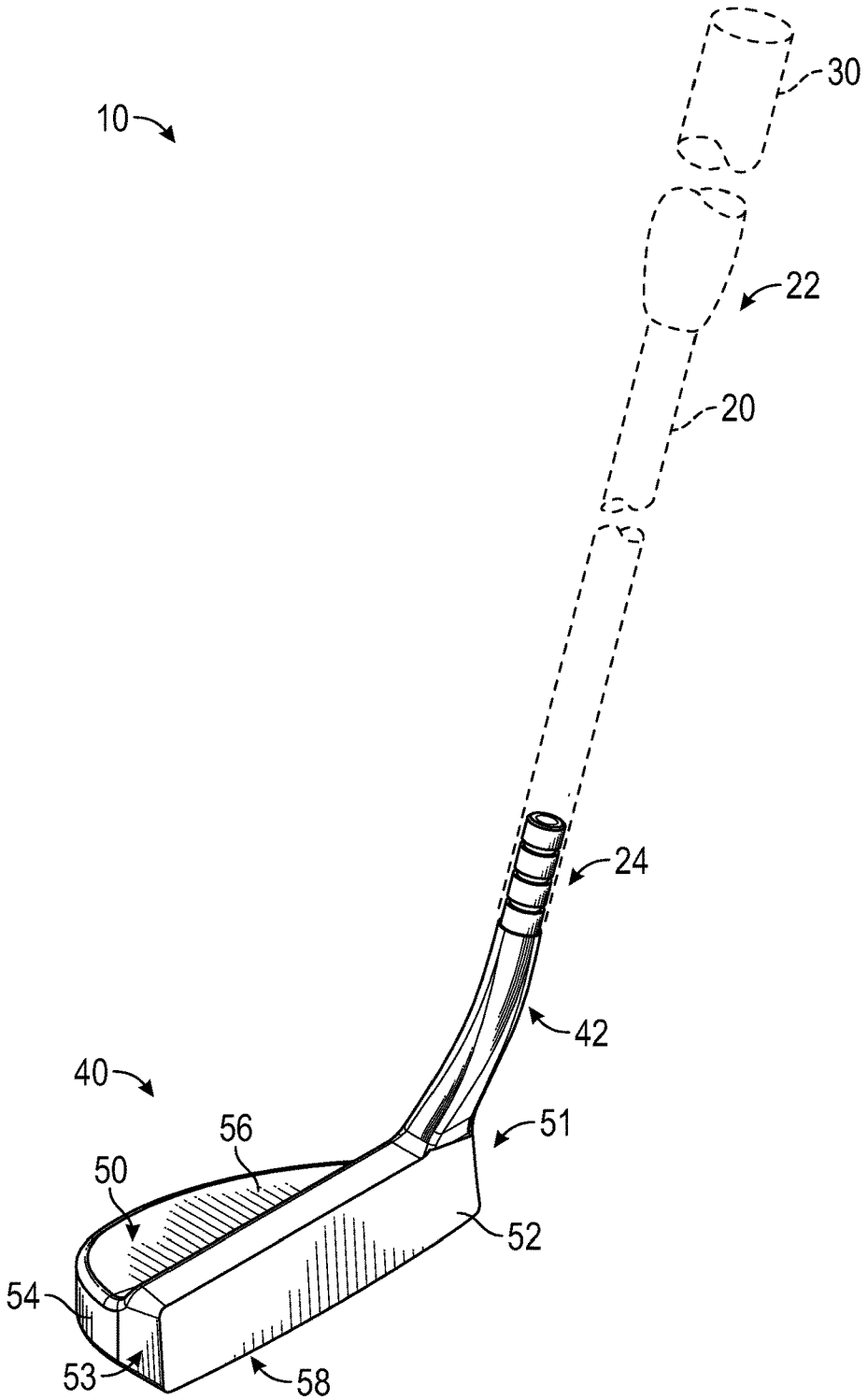
FIG. 1 is a perspective view of a golf club having a shaft, a grip, and a head assembly, according to an example embodiment.

According to the example embodiment shown in FIGS. 1-15, a club, shown as golf club 10, includes a shaft, shown as club shaft 20; a handle, shown as grip 30; and a head assembly, shown as club head assembly 40, having various components. As shown in FIGS. 1-8, the club head assembly 40 includes an extension, shown as shaft extension 42, extending from a head body, shown as club head 50. As shown in FIG. 1, the club shaft 20 has a first end, shown as upper end 22, configured to receive the grip 30 to facilitate coupling the grip 30 thereto and an opposing second end, shown as lower end 24, configured to receive the shaft extension 42 of the club head assembly 40 to facilitate coupling the club head 50 thereto.

As shown in FIGS. 1-3 and 5-8, the club head 50 has a first end, shown as heel 51; an opposing second end, shown as toe 53; a first face, shown as ball striking face 52; an opposing second face, shown as rear face 54; a top surface, shown as crown 56; and a bottom surface, shown as sole 58. According to the example embodiment shown in FIGS. 1-8, the club head 50 is structured as a mallet putter head. In other embodiments, the club head 50 is structured as a different type of putter head (e.g., a blade putter head, etc.). In still other embodiments, the club head 50 is structured as another type of head other than a putter head. By way of example, the club head 50 may be structured as a wedge head, an iron head, a hybrid head, a wood head, and/or a driver head.

As shown in FIGS. 2-5, 7, and 8, the sole 58 of the club head 50 defines an opening that provides access to an internal cavity, shown as interior chamber 60. In other embodiments, the crown 56 defines an opening that provides access to the interior chamber 60. As shown in FIGS. 3,5,7, and 8, the sole 58 includes a recessed surface, shown as peripheral edge 62, that extends around the periphery of the interior chamber 60 and defines a plurality of apertures, shown as apertures 64. The interior chamber 60 is defined by a first edge, shown as rear wall 66, and a second edge, shown as front wall 68.

As shown in FIGS. 3, 5, 7, and 8, the interior chamber 60 defines a slot or recess, shown as channel 70. In other embodiments, the channel 70 is defined by and/or along an exterior surface of the club head 50 (e.g., along the crown 56, the sole 58, the rear face 54, etc.). According to the example embodiment shown in FIGS. 3, 5, 7, and 8, the channel 70 extends at least partially between the heel 51 and the toe 53 of the club head 50 along and parallel to the ball striking face 52. In some embodiments, the channel 70 additionally or alternatively extends at least partially between the heel 51 and the toe 53 of the club head 50 along the rear face 54 (e.g., the curvature thereof, etc.) of the club head 50. In some embodiments, the channel 70 includes a first channel disposed along the ball striking face 52 and a second channel disposed along the rear face 54. In other embodiments, the channel 70 extends perpendicularly between the rear face 54 and the ball striking face 52 of the club head 50.

Figure 5:
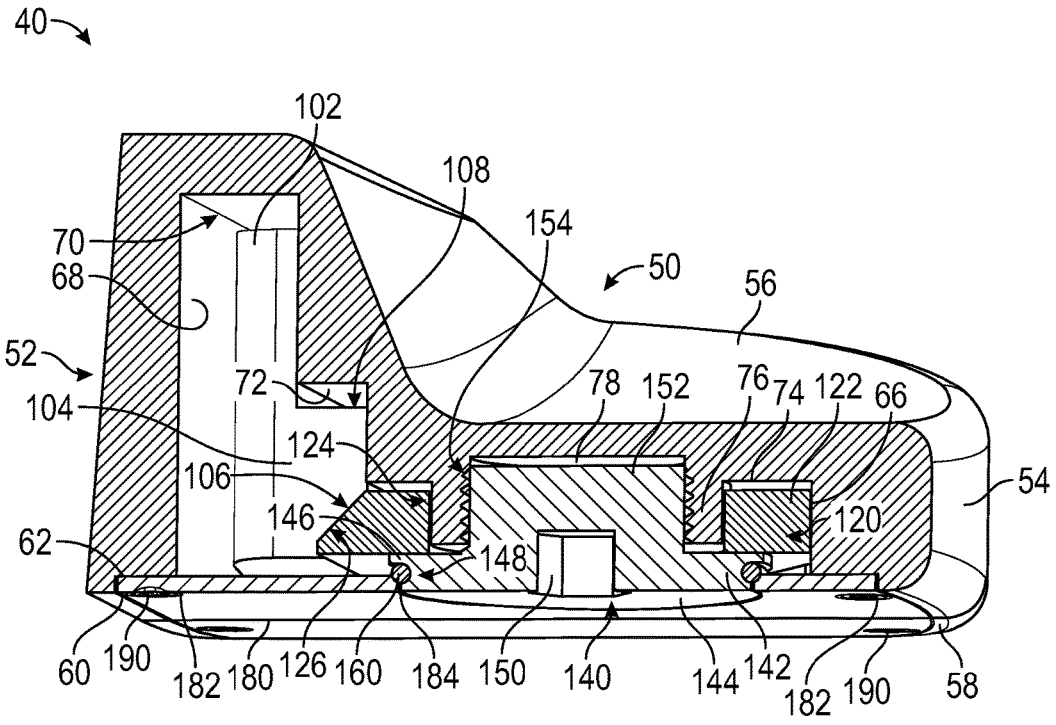
FIG. 5 is a detailed cross-sectional view of the head assembly of FIG. 1, according to an example embodiment.
Figure 7:
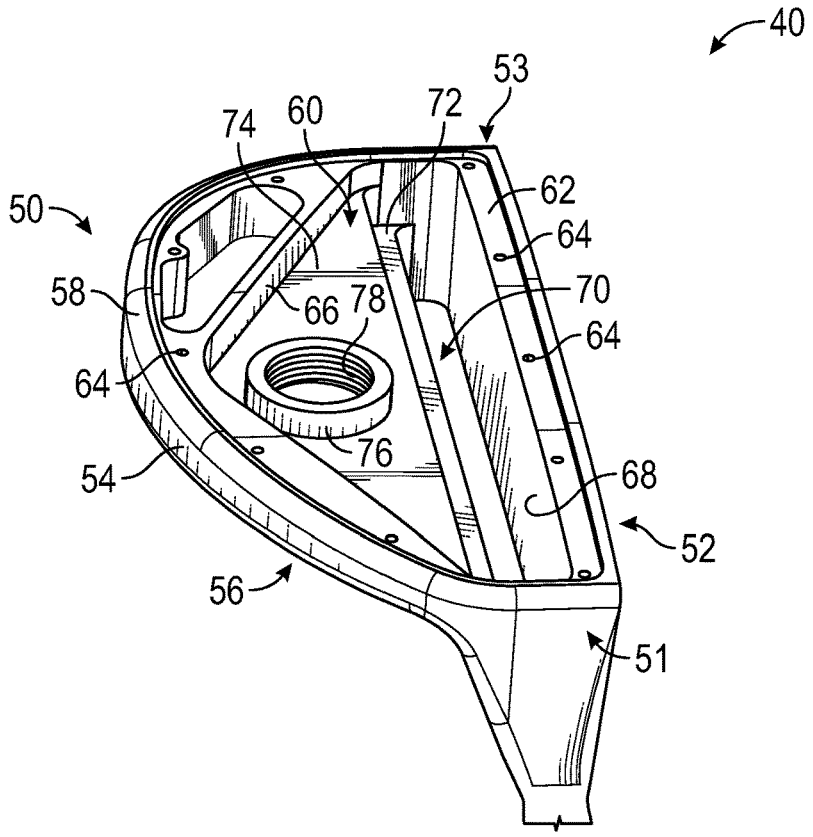
FIG. 7 is a bottom perspective view of a head of the head assembly of FIG. 1, according to another example embodiment.
Figure 8:
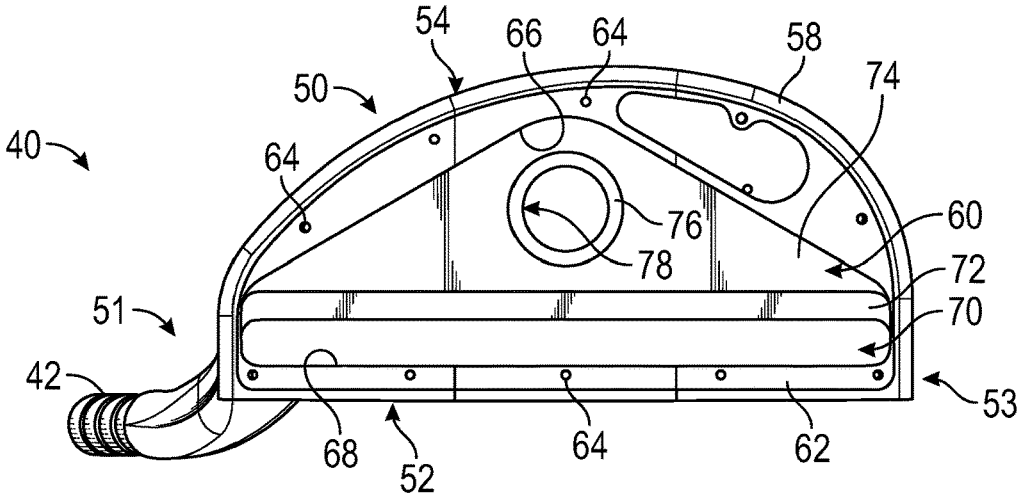
FIG. 8 is a bottom view of the head of FIG. 7, according to an example embodiment.

As shown in FIGS. 5, 7, and 8, the channel 70 includes a protrusion, shown as projection 72, positioned opposite the front wall 68 of the channel 70 (e.g., between the front wall 68 and the rear wall 66, etc.). As shown in FIGS. 3, 5, 7, and 8, the interior chamber 60 defines a surface, shown as ledge 74, extending from the rear wall 66 and recessed relative to the peripheral edge 62 such that the ledge 74 is positioned adjacent and along the channel 70 (e.g., along an inner wall of the channel 70, proximate and vertically spaced from the projection 72, etc.). As shown in FIGS. 5, 7, and 8, the ledge 74 has an extension, shown as protrusion 76, extending from the ledge 74 and defining an interface, shown as fastener interface 78.

Figure 12:
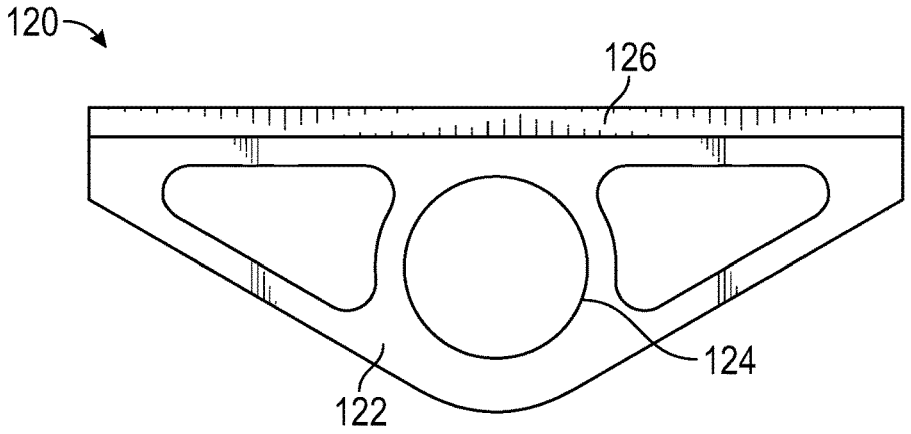
FIGS. 12 and 13 are various views of a retaining element of the head assembly of FIG. 1, according to an example embodiment.
Figure 13:
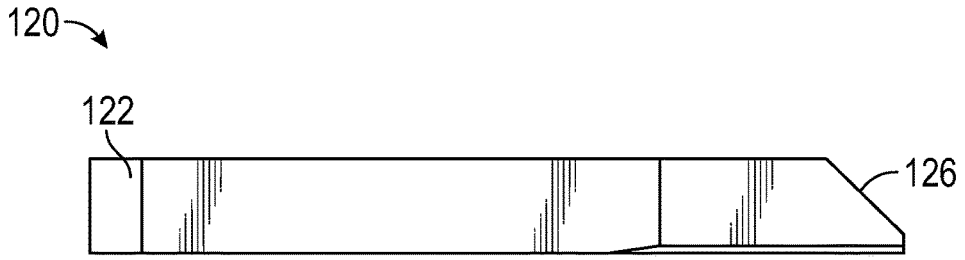
Figure 14:
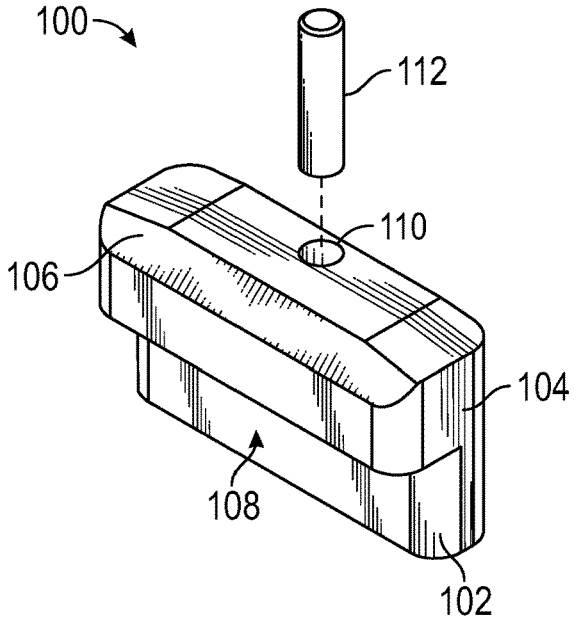
FIGS. 14 and 15 are various views of a weight of the head assembly of FIG. 1, according to an example embodiment.
Figure 15:
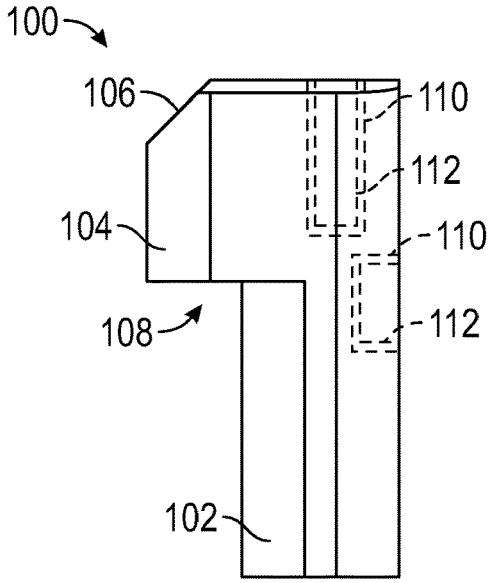

As shown in FIGS. 2-6 and 9-15, the club head assembly 40 includes a weighted element, shown as weight 100; a retaining or securing element, shown as clamp 120; a fastener, shown as clamp fastener 140; a sealing element; shown as O-ring 160; a cover (e.g., a plate, a cap, etc.), shown as sole plate 180; and a plurality of fasteners, shown as sole plate fasteners 190. As shown in FIGS. 5, 14, and 15, the weight 100 includes a first portion, shown as main body 102, and a second portion, shown as protrusion 104, extending from the main body 102. The protrusion 104 defines a first interface (e.g., a chamfered edge, etc.), shown as clamp interface 106 (e.g., at an upper end thereof, etc.), and a second interface, shown as overhang 108, between the main body 102 and the protrusion 104.

Figure 4:
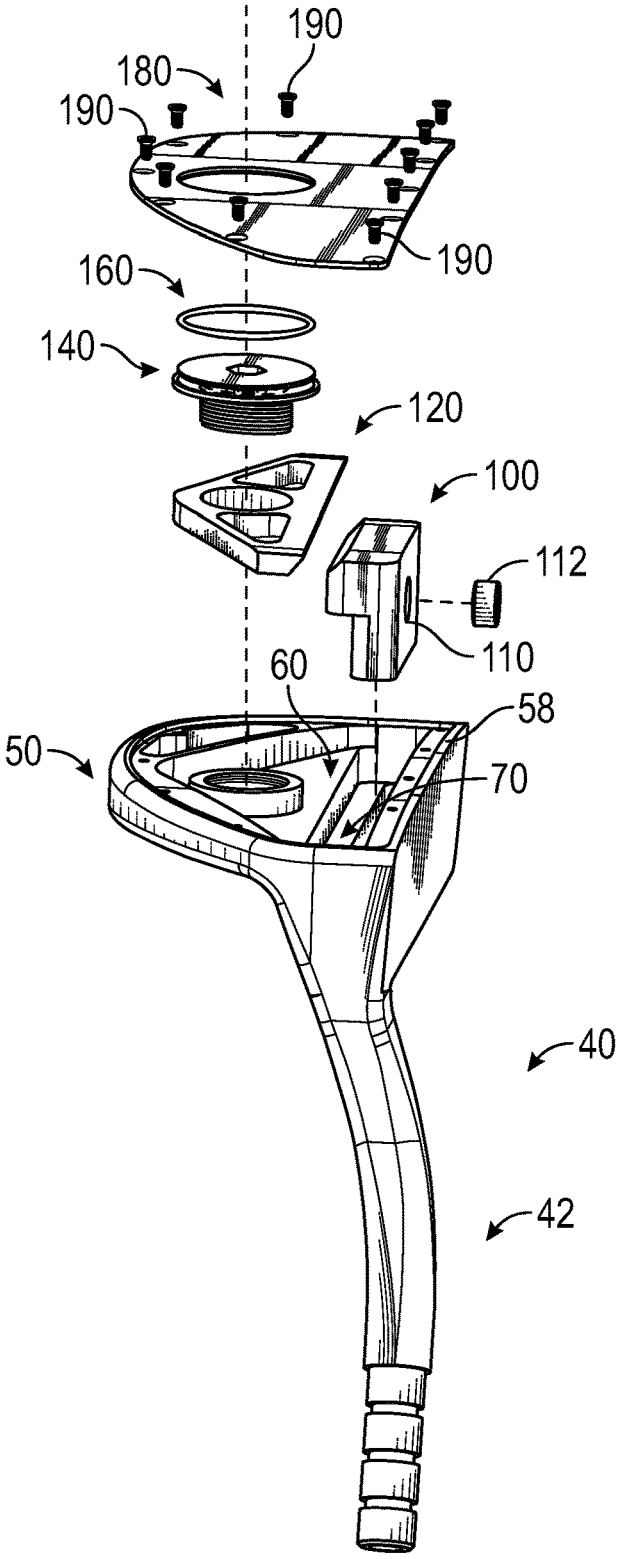
FIG. 4 is an exploded view of the head assembly of FIG. 1, according to an example embodiment.

As shown in FIGS. 4, 14, and 15, the weight 100 defines an aperture, shown as aperture 110. As shown in FIGS. 14 and 15, the aperture 110 is defined by the upper end of the weight 100. As shown in FIGS. 4 and 15, the aperture 110 is additionally or alternatively defined by a sidewall of the weight 100 (e.g., the side opposite the overhang 108, etc.). In other embodiments, the aperture 110 is otherwise positioned about the weight 100. In still other embodiments, the weight 100 does not define the aperture 110. As shown in FIGS. 4, 14, and 15, the aperture 110 is configured to selectively (e.g., releasably, etc.) receive an insert, shown as magnetically attractive element 112. In one embodiment, the magnetically attractive element 112 is manufactured from a magnetically attractive material (e.g., iron, nickel, cobalt, etc.) and/or is a magnet. In other embodiments, the weight 100 does not include the magnetically attractive element 112 (e.g., in embodiments where the weight 100 does not define the aperture 110, etc.). In one embodiment, the weight 100 is manufactured from a high-density (e.g., a high mass, etc.) and/or a non-magnetically attractive (or weakly/minimally attractive) material (e.g., lead, tungsten, steel, titanium, magnesium, aluminum, etc.). In some embodiments, the weight 100 is additionally or alternatively manufactured from a magnetically attractive material (e.g., in embodiments where the weight 100 does not define the aperture 110, etc.).

As shown in FIGS. 3-6, the weight 100 is selectively received within and repositionable along the channel 70 of the interior chamber 60 of the club head 50. According to an example embodiment, a position of the weight 100 is continuously and infinitely adjustable within the channel 70 (i.e., there are no predefined, discrete location for which the weight 100 is movable between). In an alternative embodiment, the channel 70 defines a plurality of discrete location that the weight 100 is repositionable between. As shown in FIG. 5, the main body 102 of the weight 100 is received within the channel 70 between the front wall 68 and the projection 72, and the protrusion 104 of the weight 100 is received within the channel 70 such that the overhang 108 engages with the projection 72.

According to an example embodiment, the weight 100 has a mass between 1 gram ("g") and 100 g. By way of example, the weight 100 may have a mass of 1 g, 2 g, 4 g, 6 g, 8 g, 10 g, 12 g, 14 g, 16 g, 18 g, 20 g, 25 g, 30 g, 40 g, 50 g, 60 g, 75 g, 100 g, and/or any mass therebetween. In other embodiments, the weight 100 has a mass greater than 100 g (e.g., 120 g, 150 g, 175 g, 200 g, etc.). According to an example embodiment, the weight 100 is selectively interchangeable such that a first weight having a first mass may be replaced with a second weight having a second, different mass. In some embodiments, the mass of the weight 100 is selectively adjustable by adding or removing portions thereto/therefrom (e.g., stackable weights, different inserts, etc.).

Figure 3:
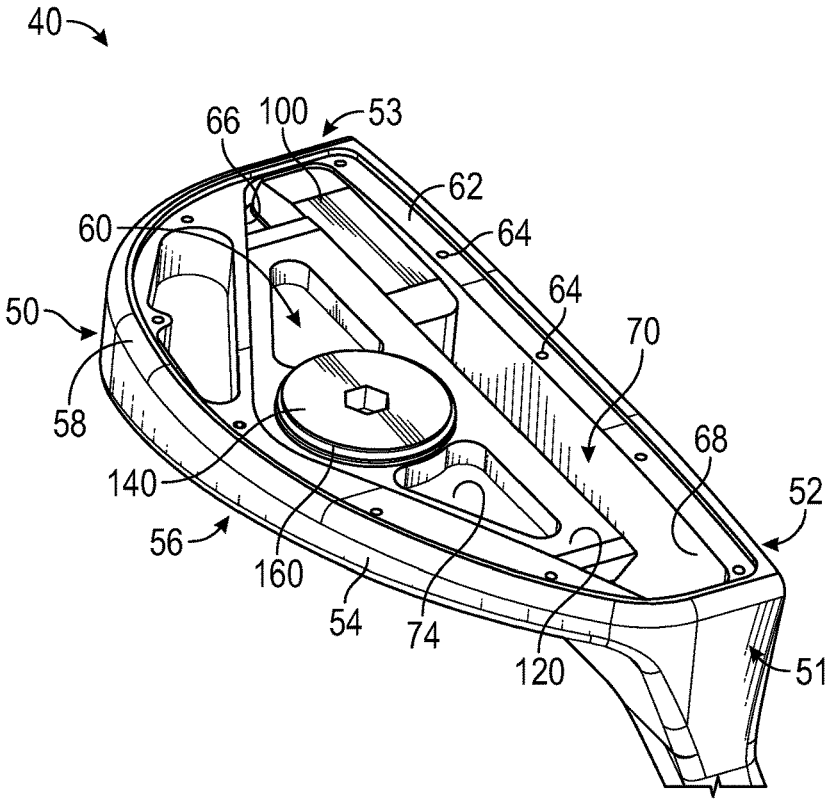
FIG. 3 is a detailed interior view of the head assembly of FIG. 1, according to an example embodiment.

As shown in FIGS. 5, 12, and 13, the clamp 120 includes a plate, shown as clamp plate 122. The clamp plate 122 defines a first interface, shown as clamp aperture 124, and a second interface (e.g., a chamfered edge, etc.), shown as weight interface 126. According to the example embodiment shown in FIGS. 3, 4, and 12, the clamp 120 has a generally triangular shape. In other embodiments, the clamp 120 is otherwise shaped (e.g., rectangular, irregular shaped, curved to correspond with the rear face 54, etc.). As shown in FIGS. 3-5, the clamp 120 is selectively received within the interior chamber 60 of the club head 50 and disposed against the rear wall 66 and along the ledge 74 such that the weight interface 126 is positioned to selectively engage with the clamp interface 106 of the weight 100 to secure the weight 100 in a selected position. As shown in FIG. 5, the clamp aperture 124 is positioned to align with and receive the protrusion 76. In other embodiments, another type of retaining or securing element is used. By way of example, any sort of approach that facilitates moving the weight to different positions within the interior chamber 60 and locking the weight 100 into a selected position may be used (e.g., using an expandable weight, a spring biased retaining element, a fastener, a latch, a clip, etc.).

Figure 2:
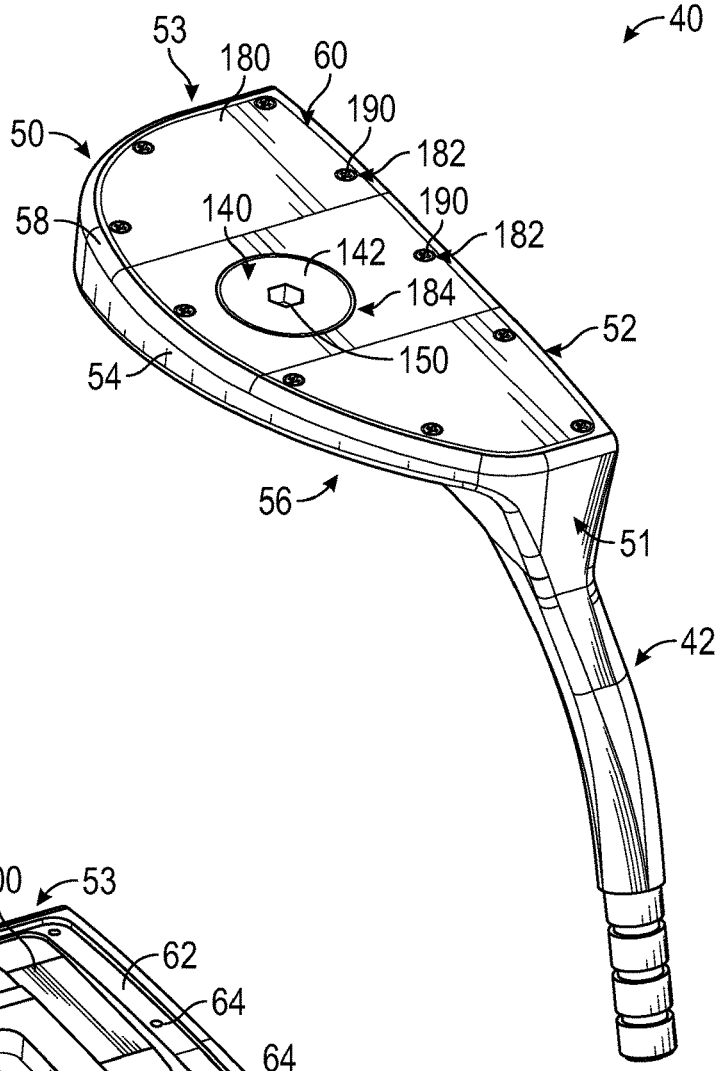
FIG. 2 is a bottom perspective view of the head assembly of FIG. 1, according to an example embodiment.
Figure 10:
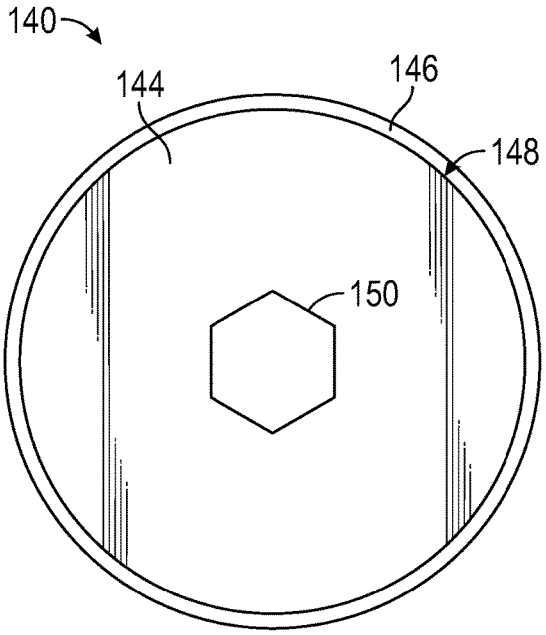
FIGS. 10 and 11 are various views of a fastener of the head assembly of FIG. 1, according to an example embodiment.
Figure 11:
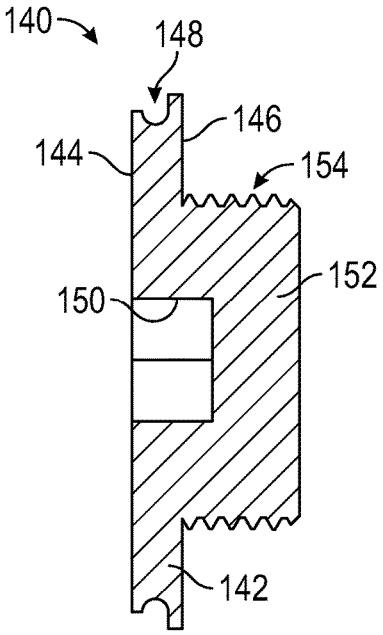

As shown in FIGS. 5, 10, and 11, the clamp fastener 140 includes a first portion, shown as fastener head 142, and a second portion, shown as protrusion 152, extending from the fastener head 142. The fastener head 142 of the clamp fastener 140 includes a first surface, shown as top surface 144, and a second surface, shown as bottom surface 146. According to an example embodiment, the bottom surface 146 of the fastener head 142 has a greater diameter than the top surface 144 of the fastener head 142. As shown in FIGS. 5, 10, and 11, the fastener head 142 defines a recess, shown as recess 148, that extends around the periphery thereof. As shown in FIGS. 3 and 5, the recess 148 is configured to receive the O-ring 160. As shown in FIGS. 2, 10, and 11, the top surface 144 of the fastener head 142 defines a recess, shown as tightening interface 150. As shown in FIGS. 5 and 11, the protrusion 152 of the clamp fastener 140 includes an interface, shown as threaded interface 154.

Figure 6:
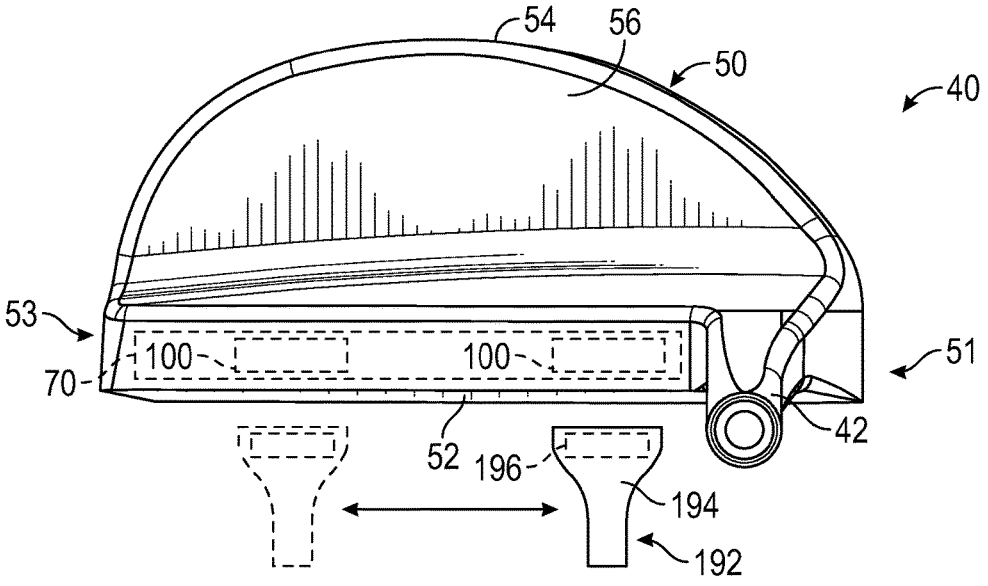
FIG. 6 is a top view of an adjuster usable with the head assembly of FIG. 1, according to an example embodiment.

As shown in FIGS. 3, 5 and 6, the clamp fastener 140 is selectively received within the interior chamber 60 of the club head 50 and positioned to selectively secure the clamp 120 to the ledge 74. As shown in FIG. 5, the protrusion 152 of the clamp fastener 140 is configured to extend through the clamp aperture 124 and be received by the protrusion 76 such that the threaded interface 154 engages (e.g., treadably engages, matingly engages, etc.) with the fastener interface 78 to selectively secure the clamp 120 about the protrusion 76, between the ledge 74 and the bottom surface 146 of the fastener head 142 of the clamp fastener 140.

Figure 9:
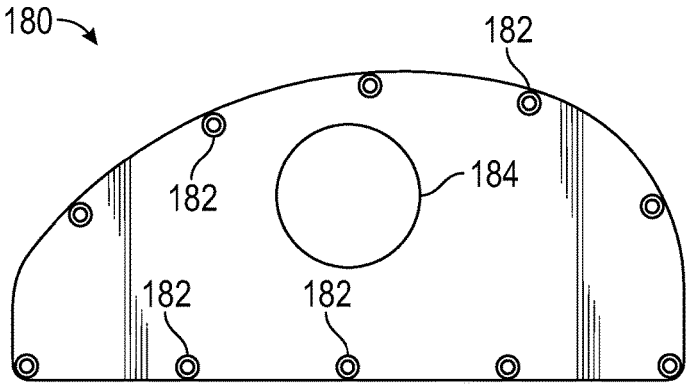
FIG. 9 is a bottom view of a cover of the head assembly of FIG. 1, according to an example embodiment.

As shown in FIGS. 2, 5, and 9, the sole plate 180 defines a plurality of apertures, shown as securing apertures 182, positioned around the periphery of the sole plate 180 and an aperture, shown as through-hole 184. As shown in FIGS. 2 and 5, the sole plate 180 is positioned to enclose the interior chamber 60 of the club head 50 defined in the sole 58 and the components of the club head assembly 40 therein (e.g., the weight 100, the clamp 120, the clamp fastener 140, etc.). In other embodiments, the sole plate 180 is replaced with a crown plate that is positioned to enclose the interior chamber 60 of the club head 50 defined in the crown 56 (e.g., in embodiments where the crown 56 defines the opening to the interior chamber 60, etc.). As shown in FIG. 5, the periphery of the sole plate 180 rests along the peripheral edge 62 such that the securing apertures 182 align with the apertures 64 defined by the peripheral edge 62. As shown in FIGS. 2 and 5, the securing apertures 182 and the apertures 64 are configured to receive the sole plate fasteners 190 to releasably couple and secure the sole plate 180 to the club head 50.

As shown in FIGS. 2 and 5, the through-hole 184 of the sole plate 180 is positioned to align with the fastener head 142 of the clamp fastener 140 such that the tightening interface 150 defined by the top surface 144 of the clamp fastener 140 is exposed through the sole plate 180 (e.g., the top surface 144 of the clamp fastener 140 forms a portion of the exterior of the club head 50, etc.). As shown in FIG. 5, the O-ring 160 is positioned to substantially seal the interface between the through-hole 184 of the sole plate 180 and the fastener head 142 of the clamp fastener 140 (e.g., thereby effectively sealing the interior chamber 60 from dirt, debris, water, etc.).

According to an example embodiment, engaging the tightening interface 150 (e.g., with a corresponding tool such as a screw driver, a drill, an allen wrench or hex key, a torx key, a socket, etc.) to tighten or loosen the clamp fastener 140 facilitates engaging and disengaging the clamp 120 with the weight 100. By way of example, tightening the clamp fastener 140 may cause the bottom surface 146 of the fastener head 142 to press down on the clamp plate 122 such that the weight interface 126 of the clamp 120 engages with the clamp interface 106 of the weight 100 to effectively secure the weight 100 at a desired position along the channel 70 (e.g., reconfiguring the clamp 120 into a locking position or configuration, etc.). By way of another example, loosening the clamp fastener 140 may cause the bottom surface 146 of the fastener head 142 to release from the clamp plate 122 such that the weight interface 126 of the clamp 120 disengages from the clamp interface 106 of the weight 100 to facilitate translational movement of the weight 100 within and along the channel 70 (e.g., reconfiguring the clamp 120 into an unlocking position or configuration, to adjust the center of gravity of the club head 50, etc.).

According to the example embodiment shown in FIG. 6, an adjuster, shown as magnetic adjuster 192, may be used with the club head 50 (e.g., in embodiments where the weight 100 is manufactured from a magnetically attractive material and/or includes the magnetically attractive element 112, etc.). As shown in FIG. 6, the magnetic adjuster 192 includes a body, shown as housing 194, that is configured to receive (e.g., store, hold, etc.) a magnetic element, shown as magnet 196. In some embodiments, the magnetic adjuster 192 include a cap that surrounds the magnet 196 and/or the housing 194 is formed around the magnet 196 to enclose the magnet 196 therein. In other embodiments, the magnetic adjuster 192 does not include the magnet 196, but rather includes a magnetically attractive material (e.g., in embodiments where the magnetically attractive element 112 is a magnet, etc.).

As shown in FIG. 6, the magnetic adjuster 192 is configured to attract the weight 100 (e.g., the magnetically attractive element 112 disposed therein, etc.) such that the magnetic adjuster 192 may be translated along the channel 70 externally from the interior chamber 60 (e.g., along the ball striking face 52 as shown in FIG. 6, along the rear face 54 in embodiments where the channel 70 extends along the rear face 54, along the sole plate 180 and/or the crown 56 in embodiments where the channel 70 extends perpendicularly between the rear face 54 and the ball striking face 52, etc.) to selectively reposition the weight 100 in any desired position along the channel 70 (e.g., while the clamp 120 is disengaged from the weight 100, etc.), without having to remove the sole plate 180 to access the interior chamber 60 (e.g., without direct physical manipulation of or contact with the weight 100, etc.). The magnetic adjuster 192 may advantageously provide an indication to the current position of the weight 100 along the channel 70, again without having to remove the sole plate 180 to access the interior chamber 60. The clamp fastener 140 may thereafter be engaged (e.g., tightened, etc.) to reconfigure the clamp 120 from the disengaged configuration to the engaged configuration to secure the weight 100 in the selected position along the channel 70. In other embodiments, the adjuster does not include the magnetic adjuster 192, but rather the club head 50 includes a worm gear mechanism and/or a screw gear mechanism coupled to the weight 100 that facilitates repositioning the weight 100 along the channel 70 externally from the interior chamber 60.

In some embodiments, one or more components of the golf club 10 and/or the club head assembly 40 are provided and/or sold individually and/or as a kit. By way of example, the club head assembly 40 may be provided and/or sold as a kit including the club head 50, one or more of the weights 100 (e.g., different mass weights, etc.), the clamp 120, the clamp fastener 140, the O-ring 160, the sole plate 180, and/or the sole plate fasteners 190. By way of another example, the golf club 10 may be provided and/or sold as a kit including one or more of the club shafts 20, one or more of the grips 30, and/or one or more club head assemblies 40 (e.g., a putter head, a wedge head, an iron head, a hybrid head, a driver head, etc.) including one or more of the components thereof (e.g., one or more of the weights 100, the clamp 120, the clamp fastener 140, the O-ring 160, the sole plate 180, the sole plate fasteners 190, etc.). By way of yet another example, a plurality of the weights 100 having various different masses may be provided and/or sold as a kit. By way of still another example, one or more of the weights 100 (e.g., different mass weights, etc.) and the magnetic adjuster 192 may be provided and/or sold as a kit.

Figure 16:
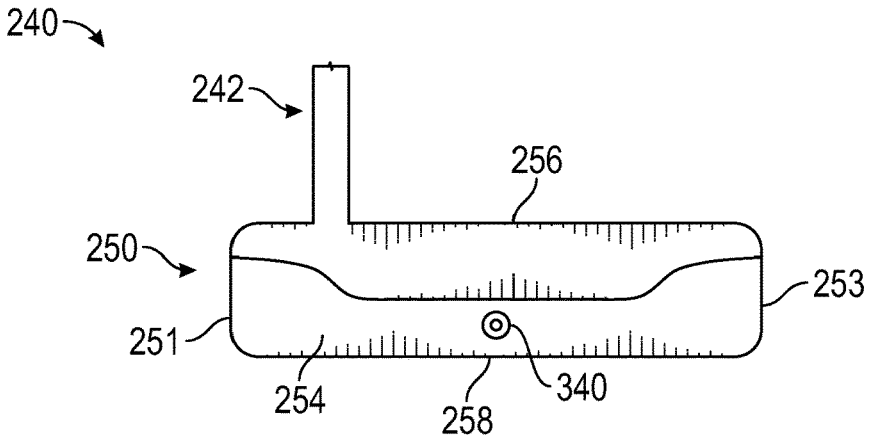
FIGS. 16-18 are various views of a head assembly, according to another example embodiment.
Figure 17:
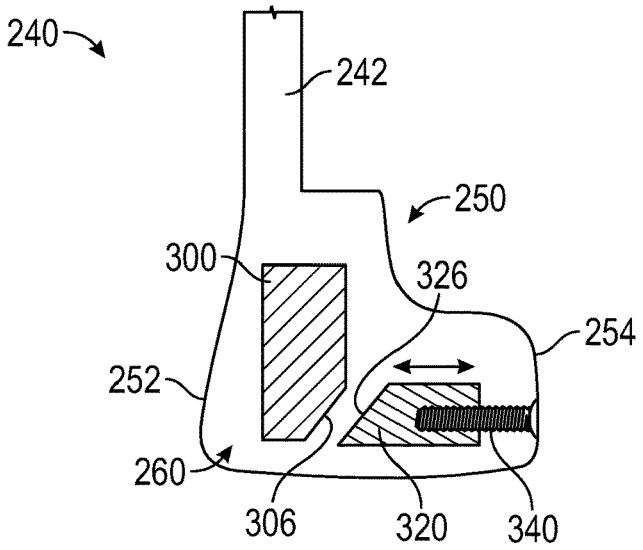
Figure 18:
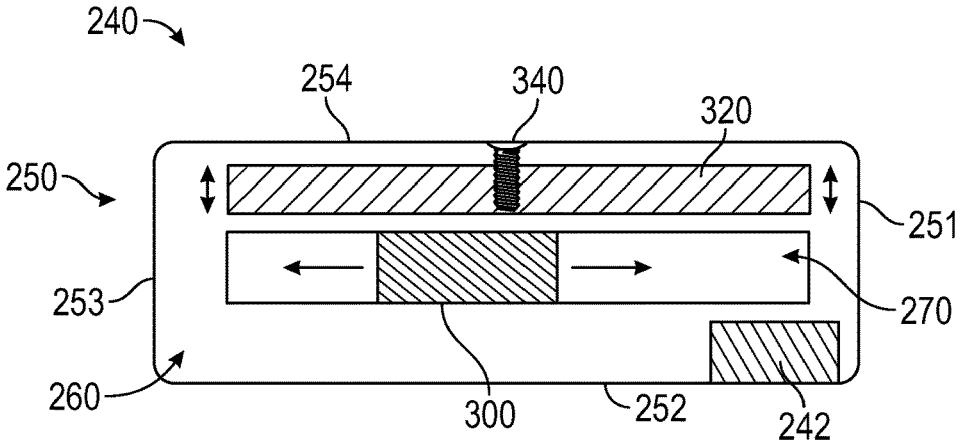

According to the example embodiment shown in FIGS. 16-18, a second head assembly, shown as club head assembly 240, may replace the club head assembly 40. As shown in FIGS. 16-18, the club head assembly 240 includes an extension, shown as shaft extension 242, extending from a head body, shown as club head 250. According to an example embodiment, the lower end 24 of the club shaft 20 is configured to receive the shaft extension 242 of the club head assembly 240 to facilitate coupling the club head 250 thereto. As shown in FIGS. 16-18, the club head 250 has a first end, shown as heel 251; an opposing second end, shown as toe 253; a first face, shown as ball striking face 252; an opposing second face, shown as rear face 254; a top surface, shown as crown 256; and a bottom surface, shown as sole 258. According to the example embodiment shown in FIGS. 16-18, the club head 250 is structured as a blade putter head.

As shown in FIGS. 17 and 18, the club head 250 defines an internal cavity, shown as interior chamber 260, that includes a slot or recess, shown as channel 270. According to the example embodiment shown in FIG. 18, the channel 270 extends at least partially between the heel 251 and the toe 253 of the club head 250 along and parallel to the ball striking face 252. In some embodiments, the channel 270 additionally or alternatively extends at least partially between the heel 251 and the toe 253 of the club head 250 along the rear face 254 of the club head 250. In some embodiments, the channel 270 includes a first channel disposed along the ball striking face 52 and a second channel disposed along the rear face 254. In other embodiments, the channel 270 extends perpendicularly between the rear face 254 and the ball striking face 252 of the club head 250.

As shown in FIGS. 17 and 18, the club head assembly 240 includes a weighted element, shown as weight 300; a retaining element, shown as clamp 320; and a fastener, shown as clamp fastener 340. The weight 300, the clamp 320, and/or the clamp fastener 340 may be substantially similar (e.g., in shape, size, function, material, etc.) to the weight 100, the clamp 120, and/or the clamp fastener 140 shown in and as described above in regards to FIGS. 1-15. In some embodiments, the weight 300 and the clamp 320 are permanently disposed within the club head 250. In some embodiments, the club head assembly 240 includes a sole plate similar to the sole plate 180 to facilitate selectively accessing the interior chamber 260.

As shown in FIG. 18, the weight 300 is received within and repositionable along the channel 270 of the interior chamber 260 of the club head 250. According to an example embodiment, a position of the weight 300 is continuously and infinitely adjustable within the channel 270 (i.e., there are no predefined, discrete location for which the weight 300 is movable between). In an alternative embodiment, the channel 270 defines a plurality of discrete location that the weight 300 is repositionable between. As shown in FIG. 17, the weight 300 defines an interface (e.g., a chamfered edge, etc.), shown as clamp interface 306 (e.g., at a lower end thereof, etc.).

As shown in FIGS. 17 and 18, the clamp 320 is received within and repositionable within the interior chamber 260 of the club head 250. As shown in FIG. 17, the clamp 320 defines an interface, shown as weight interface 126. As shown in FIGS. 16-18, the clamp fastener 340 extends through the rear face 254 of the club head 250 and interfaces with (e.g., is received by, etc.) the clamp 320.

According to an example embodiment, engaging the clamp fastener 340 (e.g., with a corresponding tool such as a screw driver, a drill, an allen wrench or hex key, a torx key, a socket, etc.) facilitates engaging and disengaging the clamp 320 with the weight 300. By way of example, tightening the clamp fastener 340 may cause the clamp 320 to translate away from the weight 300 such that the weight interface 326 of the clamp 320 disengages from the clamp interface 306 of the weight 300 to facilitate translational movement of the weight 300 within and along the channel 270 (e.g., reconfiguring the clamp 320 into an unlocking position or configuration, etc.). The weight 300 may be repositioned similar to the weight 100 as described above. By way of another example, loosening the clamp fastener 340 may cause the clamp 320 to translate towards the weight 300 such that the weight interface 326 of the clamp 320 engages with the clamp interface 306 of the weight 300 to effectively secure the weight 300 at a desired position along the channel 270 (e.g., reconfiguring the clamp 320 into a locking position or configuration, etc.).

According to an example embodiment, a method of using a golf club head (e.g., the club head assembly 40, the club head assembly 240, etc.) may be as follows. First, a golf club head may be provided that defines an interior chamber (e.g., the interior chamber 60, the interior chamber 260, etc.). A weight (e.g., the weight 100, the weight 300, etc.) may be selectively received and repositionable (e.g., slidable, translatable, interchangeable, etc.) within the interior chamber (e.g., the channel 70, the channel 270, etc. thereof). The weight may include a magnetically attractive material (e.g., the magnetically attractive element 112, etc.). A retaining element (e.g., the clamp 120, the clamp 320, etc.) may be positioned to selectively engage the weight to secure the weight in a desired position. A fastener (e.g., the clamp fastener 140, the clamp fastener 340, etc.) may be positioned to facilitate adjusting the position of the retaining element (e.g., between an engaged position and a disengaged position, etc.). A cover (e.g., the sole plate 180, the crown plate, etc.) may releasably couple to the golf club head and be positioned to selectively enclose the interior chamber and the components of the golf club head therein. The cover may define an aperture positioned to align with the fastener to facilitate engaging (e.g., adjusting, tightening, loosening, etc.) the fastener with or without removing the cover.

Second, the fastener may be adjusted (e.g., loosened, tightened, etc. with a corresponding tool) to disengage the retaining element from the weight such that the weight is freely repositionable within the interior chamber (e.g., along the channel 70, the channel 270, etc.). Third, an adjuster (e.g., the magnetic adjuster 192, a worm/screw gear mechanism, etc.) may be used to reposition the weight within the interior chamber from a first, current position to a second position without removing the cover and/or directly, physically engaging the weight to manipulate the position thereof within the interior chamber. Fourth, the fastener may be readjusted (e.g., tightened, loosened, etc.) to engage the retaining element with the weight to secure the weight in the second position.

According to an example embodiment, the method of using the golf club head as detailed above facilitates easily moving and fixing the weight at any location within the interior chamber (e.g., along the channel 70, etc.) without direct, physical user manipulation of the weight in such a way to maximize the aesthetic appearance of the golf club head while preserving the function of the movable weight. Such an entirely enclosed system may have various advantages. By way of example, the enclosed system may have minimal or no effect on the appearance of the golf club head at address and from other viewing angles (e.g., the golf club head appears to be an ordinary golf club head, etc.). By way of another example, the adjustment mechanism is completely enclosed and may thereby be protected from dirt, debris, grass, etc. By way of yet another example, the adjustment mechanism may maximize the adjustability of the center of gravity of the golf club head by facilitating the repositioning of the weight from the interior or the exterior of the golf club head.

Thus, some additional embodiments relate to methods of adjusting or repositioning the weight of a golf club head and/or a golf club. The methods may include for example, providing a golf club head with adjustable or moveable weight. The adjustable or moveable weight may be moved with a magnet for example. The weight may be moved using any other mechanism that permits movement or adjustment of the weight that is enclosed within the club head when the movement is desired. The moveable or adjustable weight may be enclosed within the club head or in some way enclosed so as to prevent dirt, grass, or other debris from contacting or interfering with the weights or the adjustment mechanism. The method may include the use of any component or device as described herein, including any of the depicted and described adjustable golf club heads and golf clubs.

It is important to note that the construction and arrangement of the elements of the systems, methods, and apparatuses as shown in the example embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. It should be noted that the elements and/or assemblies of the enclosure may be constructed from any of a wide variety of materials that provide sufficient strength or durability, in any of a wide variety of colors, textures, and combinations.

Embodiments have been described in connection with the accompanying drawings. However, it should be understood that the figures are not drawn to scale. Distances, angles, shapes, etc. are merely illustrative and do not necessarily bear an exact relationship to actual dimensions and layout of the articles that are illustrated. In addition, the foregoing embodiments have been described at a level of detail to allow one of ordinary skill in the art to make and use the articles, parts, different materials, etc. described herein. A wide variety of variation is possible. Articles, materials, elements, and/or steps can be altered, added, removed, or rearranged. While certain embodiments have been explicitly described, other embodiments will become apparent to those of ordinary skill in the art based on this disclosure.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or configurations are in any way required for one or more embodiments. The terms "comprising," "including," "having," and the like are synonymous and are used inclusively, in an open-ended fashion, and do not exclude additional elements, features, acts, operations, and so forth. The term "consisting essentially of" can be used anywhere where the terms comprising, including, containing or having are used herein, but consistent essentially of is intended to mean that the claim scope covers or is limited to the specified materials or steps recited and those that do not materially affect the basic and novel characteristic(s) of the claimed invention. Also, the term "consisting of" can be used anywhere where the terms comprising, including, containing or having are used herein, but consistent of excludes any element, step, or ingredient not specified in a given claim where it is used.

Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, Z, X and Y, X and Z, Y and Z, or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

Additionally, in the subject description, the word "example" is used to mean serving as an example, instance, or illustration. Any embodiment or design described herein as "example" is not necessarily to be construed as preferred or advantageous over other embodiments or designs. Rather, use of the word example is intended to present concepts in a concrete manner. Accordingly, all such modifications are intended to be included within the scope of the present inventions. Other substitutions, modifications, changes, and omissions may be made in the design, operating conditions, and arrangement of the preferred and other example embodiments without departing from scope of the present disclosure or from the spirit of the appended claims.

The invention claimed is:

1. A golf club head, comprising:

a head body defining an interior chamber;

a weight selectively received and repositionable within the interior chamber;

a retaining element positioned to selectively engage with the weight to secure the weight in a selected position;

a cover positioned to enclose the interior chamber of the head body, wherein the cover defines an aperture; and a fastener received by the aperture of the cover, wherein the fastener is positioned to seal the aperture such that the interior chamber is completely isolated from an exterior environment, and wherein adjusting the fastener facilitates (i) selectively engaging the retaining element with the weight while the cover is installed and (ii) selectively disengaging the retaining element from the weight while the cover is installed.

2. The golf club head of claim 1, wherein the interior chamber defines a channel that receives the weight and extends at least partially between a heel and a toe of the head body.

3. The golf club head of claim 2, wherein the channel is defined along a ball striking face of the head body.

4. The golf club head of claim 2, wherein the channel is defined along a rear face of the head body.

5. The golf club head of claim 1, wherein the interior chamber defines a channel that receives the weight and extends perpendicularly at least partially between a rear face and a ball striking face of the head body.

6. The golf club head of claim 1, wherein the weight is a first weight and further comprising a second weight, wherein the second weight is interchangeable with and has a different mass than the first weight.

7. The golf club head of claim 1, wherein the weight is selectively repositionable externally from the head body while the retaining element is disengaged from the weight and without direct physical manipulation of or contact with the weight.

8. The golf club head of claim 7, wherein the weight at least one of (i) is manufactured from a magnetically attractive material and (ii) includes a magnetically attractive element that facilitates selectively repositioning the weight with a magnetic adjuster externally from the head body.

9. The golf club head of claim 1, wherein the interior chamber defines a channel that receives the weight and a ledge positioned adjacent the channel.

10. The golf club head of claim 9, wherein the retaining element is selectively disposed along the ledge to engage the weight disposed within the channel.

11. The golf club head of claim 10, wherein the fastener is positioned to selectively secure the retaining element to the ledge.

12. The golf club head of claim 1, wherein the fastener is exposed through the cover.

13. The golf club head of claim 1, wherein adjusting the fastener is configured to facilitate engaging and disengaging the retaining element with the weight to facilitate selectively repositioning the weight along the channel while the cover is installed.

14. A kit for a golf club, comprising:

a weight configured to be received within an interior chamber of a golf club head, the weight including a magnetically attractive material; and a magnetic adjuster configured to facilitate selectively repositioning the weight within the interior chamber of the golf club head;

wherein the magnetic adjuster is configured to be separate from the weight and the golf club head during use of the golf club; and wherein the weight is configured to remain within the interior chamber of the golf club head during use of the golf club.

15. The kit of claim 14, wherein the weight is a first weight, further comprising a second weight interchangeable with and having a different mass than the first weight.

16. The kit of claim 14, further comprising a retaining element configured to selectively engage with the weight to secure the weight in a selected position.

17. The kit of claim 14, further comprising a plate configured to enclose the interior chamber of the golf club head.

18. The kit of claim 14, further comprising the golf club head defining the interior chamber, wherein the golf club head includes at least one of a putter head, a wedge head, an iron head, a hybrid head, a wood head, and a driver head.

19. A golf club, comprising:

a shaft having a first end and an opposing second end;

a grip coupled to the first end of the shaft;

a head coupled to the opposing second end of the shaft, the head defining a channel; and a weight selectively received within and repositionable along the channel, wherein the weight is entirely enclosed within the channel, and wherein a position of the weight within the channel is magnetically adjustable using a magnetic adjuster that is separate from the golf club during use of the golf club.

20. The golf club of claim 19, further comprising a cover positioned to enclose the channel of the head such that the weight and the channel are completely isolated from an exterior environment.

* * * * *